US005090842A

United States Patent [19]

Montgomery

[11] Patent Number: 5,090,842

[45] Date of Patent: * Feb. 25, 1992

[54] BOAT LIFT APPARATUS AND SYSTEM

[76] Inventor: David M. Montgomery, 8912 Crestwood Dr., Fort Worth, Tex. 76179

[ * ] Notice: The portion of the term of this patent subsequent to Jan. 8, 2008 has been disclaimed.

[21] Appl. No.: 638,202

[22] Filed: Jan. 7, 1991

Related U.S. Application Data

[63] Continuation-in-part of Ser. No. 490,484, Mar. 8, 1990, Pat. No. 4,983,067.

[51] Int. Cl.[5] ..... B63C 3/06

[52] U.S. Cl. ..... 403/3; 114/44

[58] Field of Search ..... 405/1-7, 405/218, 219, 221; 114/44, 45, 48; 212/199, 267, 269; 414/678

[56] References Cited

U.S. PATENT DOCUMENTS

| | | | |
|---|---|---|---|
| 2,708,346 | 5/1955 | Smith | 405/3 |
| 2,888,152 | 5/1959 | Sugg | 414/678 |
| 3,565,271 | 2/1971 | Deck | 414/678 X |
| 4,381,723 | 5/1983 | Furst | 114/45 |
| 4,432,664 | 2/1984 | Baldyga | 405/3 |
| 4,482,268 | 11/1984 | Stevenson et al. | 405/3 |
| 4,678,366 | 7/1987 | Williamson | 405/3 |
| 4,714,375 | 12/1987 | Stevenson | 405/3 |
| 4,750,444 | 6/1988 | Lemvig | 114/45 |
| 4,832,210 | 5/1989 | Wood | 212/200 |
| 4,976,211 | 12/1990 | Reinhardt | 114/44 |
| 4,983,067 | 1/1991 | Montgomery | 405/3 |

*Primary Examiner*—David H. Corbin

*Attorney, Agent, or Firm*—Geoffrey A. Mantooth

[57] ABSTRACT

A lift apparatus has a load member, a lift cradle and a lifting arrangement. The load member has a rail or track portion which provides a path when raising and lowering the lift cradle. The load member also has a mounting portion for mounting the load member to an adjacent structure such as a dock, a pier or a wall. The mounting portion has a web, which stands off mounting hardware, such as a mounting plate, from the rail portion. The lift cradle has bearings for sliding along the rail portion. The bearings have a gap, which allow the bearings to slide along the rail portion without interference from the web. When the bearings are free of the web, the lift cradle can rotate, to deposit the load onto a dock. The lifting arrangement is rotatively coupled to the upper end of the load member, so as to rotate with the lift cradle. A lift system utilizes the lift apparatus and a wheeled cart. The load is located on the cart, which couples to the lift cradle. As the lift cradle is lifted, the cart and the load are also lifted. With the cart arrangement, no transferring of the load between a cart and the lift apparatus is required.

19 Claims, 8 Drawing Sheets

BOAT LIFT APPARATUS AND SYSTEM

This application is a continuation-in-part of U.S. application, Ser. No. 07/490,484, filed Mar. 8, 1990, now U.S. Pat. No. 4,983,067, issued Jan. 8, 1991.

FIELD OF THE INVENTION

The present invention relates to apparatuses and systems for raising and lowering a load such as a boat, jet ski or the like.

BACKGROUND OF THE INVENTION

Personal watercraft are small self-propelled boats that are used by one or two people. One such type of personal watercraft are jet skis. Jet skis, which are propelled by jets of water, are equipped with water pumps for propulsion. When a jet ski is not in use, it is desirable to store it out of the water. Because the water pump and impeller can pick up debris if the jet ski is parked on a beach, it is desirable to store the jet ski on a dock or cradle.

Jet skis are very heavy, weighing between 230–450 pounds. Therefore, some sort of lifting apparatus is needed to lift the jet ski up onto a dock (and to lower the jet ski into the water). Various prior art dock lifts have been employed to lift small boats and jet skis up out of the water. They all suffer from the disadvantage of being unable to move the load onto the dock. Instead, the prior art dock lifts merely lift the load up out of the water; the load is positioned out over the water and not over the dock. This is disadvantageous because jet skis must be removed from the lift to be stored. Because jet skis are heavy, they are difficult to move horizontally from a position out over the water onto the dock. Furthermore, servicing the jet ski while it is located out over the water on prior art boat lifts is clumsy and difficult; the operator must lean out from the dock over the water. Unlike large boats, jet skis are too small to climb on board for some types of servicing; servicing is better performed when not on board the jet ski.

Thus, it is desirable to have a boat lift apparatus that not only raises the load out of the water to a desired vertical height, but also can move the load horizontally over the dock. The prior art boat lifts appear to be limited in their directional lifting capability by their mounting arrangements to a load-bearing structure such as the bottom of the water body or the adjacent dock structure. These mounting arrangements prevent movement of the load from a position over the water to a position over the dock.

The problems with the prior art boat lifts are alleviated somewhat by installing the lift on an inside corner of a boat dock, so that the lift is bounded by the dock on two sides. However, with such an arrangement, the load must still be moved from a position over the water onto the dock. Furthermore, many docks do not have such an inside corner.

In addition to having a boat lift apparatus that moves the load both vertically and horizontally, it is desirable to have a lifting system that would eliminate manual lifting of a jet ski on and off of the lift apparatus. This is because there are many situations in which the jet ski must be loaded on and off of the lift apparatus. For instance, the jet ski may be stowed in a location (such as a garage or house) away from the lift apparatus. Or, several jet skis may utilize a single lift apparatus, thus necessitating some shuffling around of jet skis.

In the prior art, there are small wheeled carts which support jet skis off of the ground and also allow the jet ski to be easily moved from place to place. When transferring the jet ski from its cart to any type of lift apparatus, the jet ski is manually picked up off of the cart and then placed onto the lift. After use, the jet ski is transferred back to the cart by manually picking it up off of the lift and placing it onto the cart. This frees the lift for other jet skis. The loaded jet ski can then be wheeled back to its storage location. It is therefore desirable to eliminate this manual lifting of the jet ski when transferring it between the cart and the lift.

SUMMARY OF THE INVENTION

It is an object of the present invention to provide a lift apparatus for raising and lowering loads, which apparatus permits horizontal movement of the load as well as vertical movement of the load.

It is another object of the present invention to provide a lift apparatus for raising and lowering small boats from the water onto a dock surface.

It is another object of the present invention to provide a lifting system utilizing a wheeled cart for transporting a load such as a small boat, which cart is lifted by the lift apparatus so that the boat need not be manually lifted when transferring the boat between the cart and the lift.

The lift apparatus of the present invention includes an elongated load member, a lift cradle and lifting means. The load member has track means extending between upper and lower ends of the load member and has mounting means located intermediate of said upper and lower ends. The mounting means is coupled to and stood off from the track means by standoff means. The mounting means is adapted to couple to structure that is located adjacent to the load member. The lift cradle comprises guide means for guiding the lift cradle along the track means. The guide means have bearing means for slidingly engaging the track means so as to slide thereon. The bearing means have gap means for receiving the standoff means so that the bearing means can slide between the upper and lower ends of the load member. The lift cradle also comprises arm means that are coupled to the guide means. The arm means protrude outwardly and are adapted to engage a load. The bearing means allows the lift cradle to turn about the track means when the bearing means gap is free of the standoff means. The lifting means is for raising and lowering the lift cradle along the track means. The lifting means is coupled to the upper end of the load member.

In one aspect, the lifting means is rotatably coupled to the upper end of the track means, wherein the lifting means can turn about the track means when the lift cradle turns about the track means.

In another aspect, the bearing means are made of a solid material and have low friction surfaces that are in contact with the track means so as to slide thereon. The bearing means are made of ultra high molecular weight polyethylene (UHMWPE).

In still a further aspect, the arm means pivot between a deployed position for engaging a load in a stowed position wherein the arm means extend in a generally parallel direction to the track means.

The lift apparatus of the present invention allows a load to be lifted up from a lower position, and then swung horizontally to a position over a dock or some other structure, thereby eliminating the laborious task of sliding the load horizontally from a position off of the dock to a position onto the dock. This is accomplished by mounting the load member to adjacent structure, such as the dock, with mounting means that is stood off from the track means by a standoff web. Thus, the mounting means does not interfere with the sliding movement of the lift cradle along the load member. Once the lift cradle is free of the mounting means and the standoff web, the lift cradle can be rotated to rotate the load onto the dock. Furthermore, the mounting means makes installation of the load member extremely simple, eliminating the need for heavy equipment.

DESCRIPTION OF PREFERRED EMBODIMENT

Figure 1:
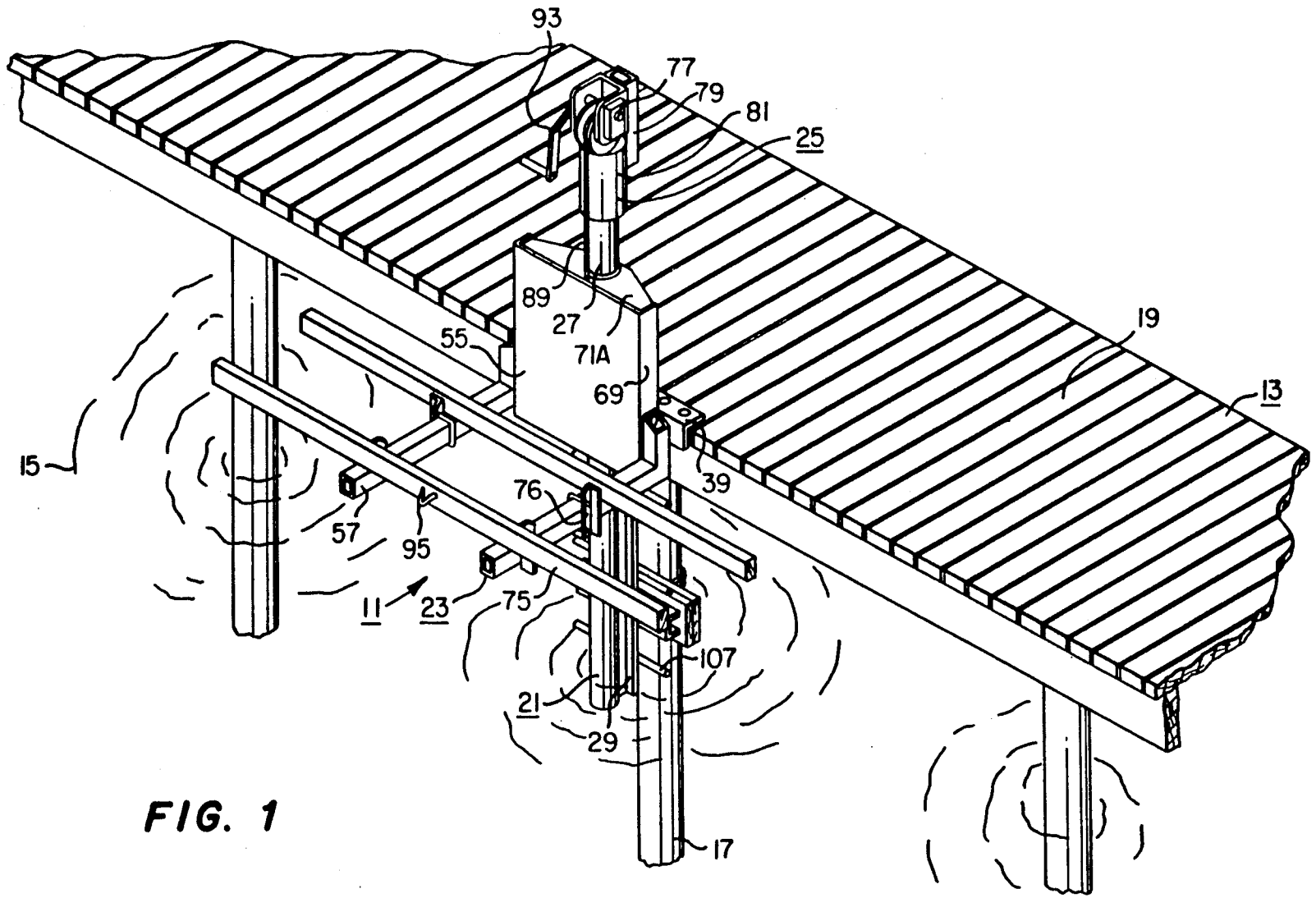
FIG. 1 is an isometric view of the lift apparatus of the present invention, in accordance with a preferred embodiment, shown mounted onto a dock with the cradle positioned over the water.

In FIG. 1, there is shown an isometric view of the lift apparatus 11 of the present invention, in accordance with a preferred embodiment. The lift apparatus 11 is shown mounted onto a dock 13. The dock, of course, extends out over water 15, and is supported by vertical piers 17 that are located along the sides of the dock. The lift apparatus is used to raise and lower small boats, such as jet skis or other types of personal watercraft, from the water 15 onto the dock walkway 19.

Referring to FIGS. 1–4, the lift apparatus 11 includes an elongated load member 21, a lift cradle 23 and lifting means 25.

The load member 21 provides a path for raising and lowering a load. The load member also transfers the weight of the lift apparatus and the load to the dock structure 13. The load member 21 has a rail portion 27 and a mounting portion 29. The rail portion 27 is a length of metal tubing, having upper and lower ends 31, 33. The upper end 31 is plugged so as to support the lifting means 25. The rail portion 27 serves as a track, upon which the cradle 23 can move up and down. The upper end portion of the rail portion allows the cradle to pivot horizontally about the rail portion. The mounting portion 29 has a web 35 and a mounting plate 37 that together form a T-shaped member when viewed in transverse cross-section (see FIG. 4). The web 35 protrudes radially outward from the tubing 27 so as to be perpendicular to a tangent of the tubing, which tangent is located at the juncture of the inner end of the web and the tubing. The mounting plate 37 is perpendicular to the outer end of the web 35. The web 35 acts as a standoff or spacer to space the mounting plate 37 or other mounting hardware (such as an angle iron 39) from the rail portion 27. Thus, there is a gap between the tubing 27 and each arm of the mounting plate 37, which gaps receive portions of the cradle 23 and also mounting apparatus for mounting the load member 21 to the dock 13. In the preferred embodiment, the mounting portion 29 is fabricated from an I-beam. The I-beam is cut longitudinally in half; one of the halves is then welded onto the tubing. The mounting portion 29 extends from the lower end 33 of the rail portion 27 to a point intermediate the upper and lower ends 31, 33 of the rail portion.

The load member 21 is installed by securing the mounting portion 29 to the dock 13 such that the load member is in a generally vertical orientation on the side of the dock. Once the lift apparatus 11 is installed, the dock 13 bears the weight of the apparatus and any load. To secure the mounting portion 29 to the dock, an angle iron 39 is coupled, by either welding or bolts, to the upper end of the mounting portion 29. The angle iron 39 may be welded directly to the web 35, after removing a segment of the mounting plate 37, or the angle iron 39 may be coupled to the mounting plate 37. The angle iron 39 is fitted onto the side of the dock walkway 19 so that one portion of the angle iron extends on top of the walkway and the other portion extends along the side edge of the walkway. The angle iron 39 is then secured to the walkway 19 with bolts. The load member 29 is then braced to the vertical pier 17 by way of a chain 40. A short length of U-shaped channel iron 41 is clamped to the mounting plate 37. Each arm of the mounting plate 37 is clamped between a clamping plate 43 and the channel iron 41. Bolts 45 provide the necessary clamping force. Interposed between the pier 17 and the channel iron 41 is a wooden spacer block 47. The thickness of the block 47 is such that the load member 21 is generally vertical. The block 47 has holes 49 therein for receiving eyebolts 51 that are secured to the channel iron 41. The chain 40 extends around the circumference of the pier 17 from eyebolt 51 to eyebolt. Before tightening the eyebolts 51 and the clamping plates 43, the chain 40 and the channel iron 41 can be slid up and down the length of the mounting plate 37 to a suitable location. The eyebolts 51 are then tightened, relative to the channel iron 41, to tighten the chain 40 around the pier 17.

When the load member 21 is installed onto the dock 13, the mounting portion 29 extends from the lower end 33 of the load member only up to the dock walkway 19. The rail portion 27 extends upwardly past the dock walkway 19 for some distance. The height of the upper end 31 of the rail portion 27 above the dock walkway 19 is such that the cradle 23 can be raised up and pivoted onto the dock 13, as will be explained in more detail hereinbelow.

The lift cradle 23 receives the load and is moved up and down the rail portion 27 of the load member 21.

Figure 3:
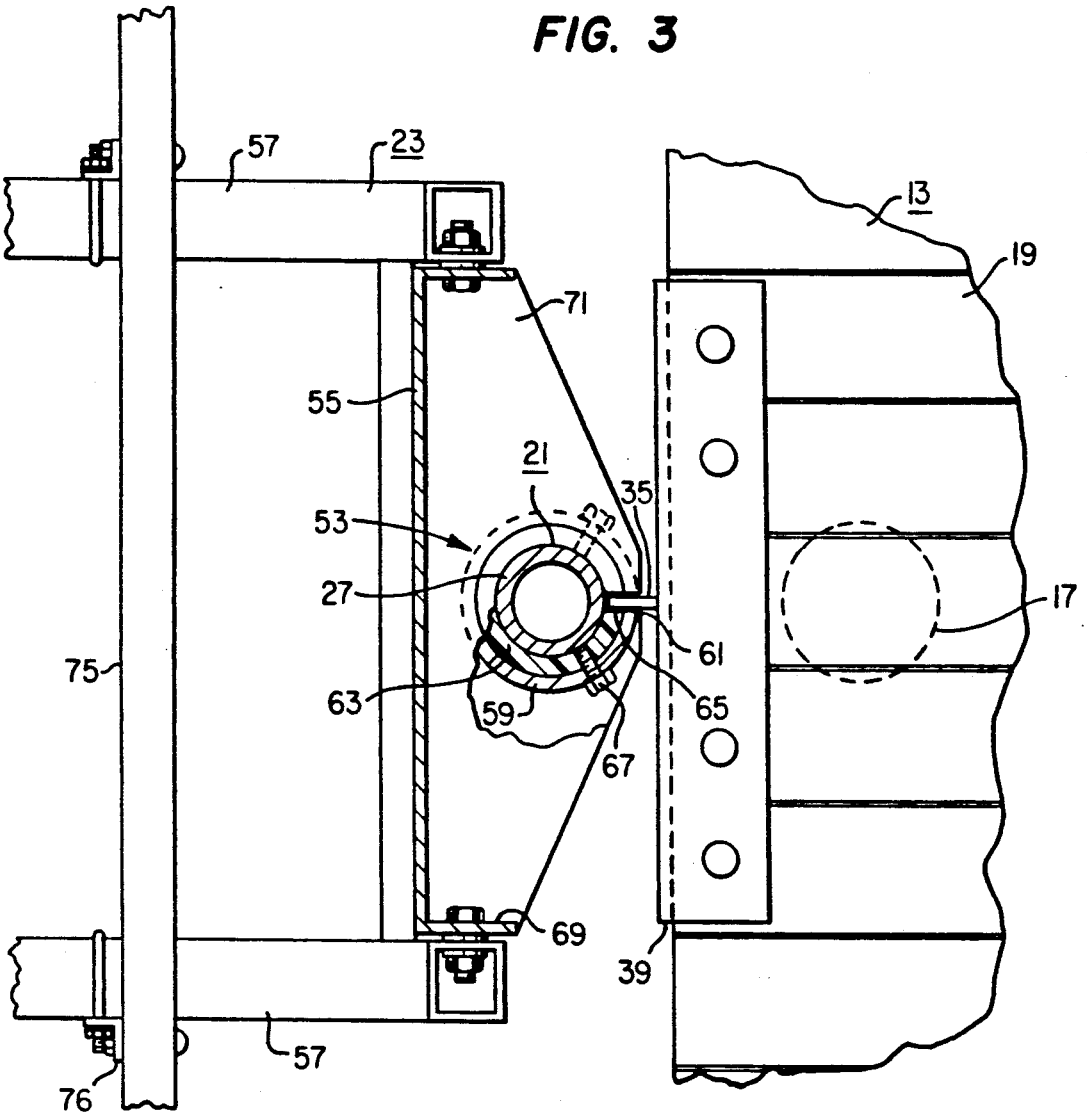
FIG. 3 is a transverse cross-sectional view, showing one of the bearings of the cradle and the dock surface.

The lift cradle 23 includes guide means 53, a back wall 55 and arms 57. The guide means 53 includes short tubular segments 59 having an inside diameter that is larger than the outside diameter of the rail portion 27 tubing. Referring to FIG. 3, each tubular segment 59 has a longitudinal gap 61 therein. Secured to the inside of each tubular segment 59 is a plastic bearing 63. Each bearing 63 is tubular, having a length that is approximately the same as the length of the respective tubular segment 59. The bearings 63 each have a gap 65 that is aligned with the gap 61 in the respective tubular segment 59. The bearings 63 are secured to the tubular segments 59 by radially oriented bolts 67. The inside diameter of the bearings 63 is slightly larger than the outside diameter of the rail portion tubing 27 such that the bearings 63 will slide along the length of the rail portion.

In the preferred embodiment, the bearings 63 are made of commercially available ultra high molecular weight polyethylene (UHMWPE), an extremely dense plastic. The bearings 63 are made of solid UHMWPE, and are machined, molded or extruded to have smooth inside diameters. The bearings have low friction surfaces for sliding along the rail portion 27 and the web 35. Although UHMWPE is preferred because it is impact resistant and may be used in both fresh and salt water environments, other types of solid bearings could be used, such as, for example, polytetrafluoroethylene (TEFLON).

Figure 8:
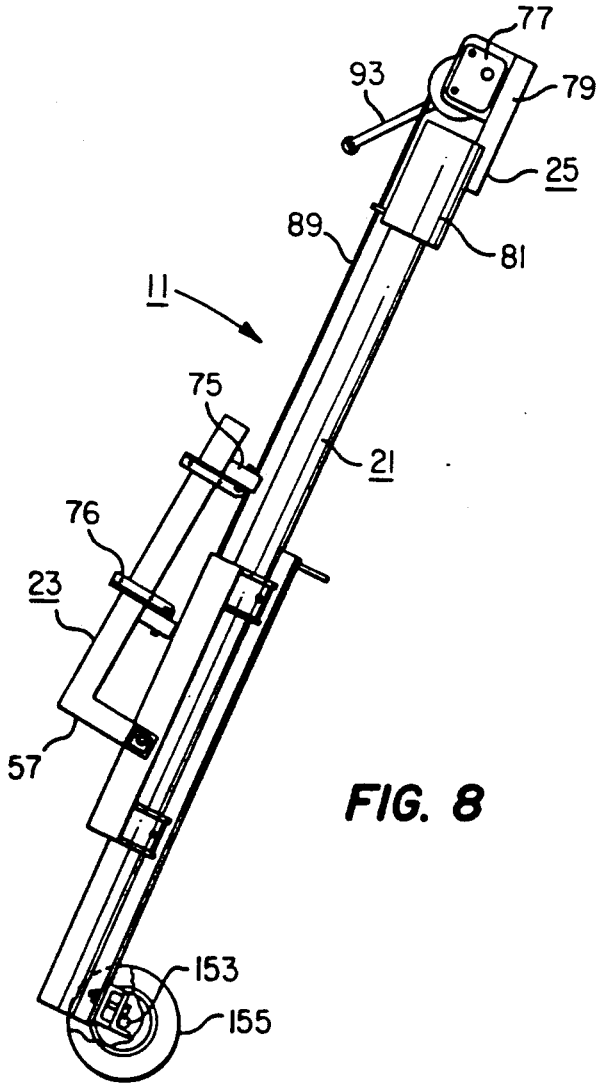
FIG. 8 is a side view of the lift apparatus, which is shown configured for wheeled transport to and from a dock site.

The back wall 55 is a large flat plate facing outwardly toward the load. The back wall 55 has side portions 69 that extend rearwardly away from the load. The guide means 53 are coupled to the back wall 55 by flat plates 71. The orientation of the back wall 55 is perpendicular to a radial line extending outwardly from the rail portion 27, when the cradle 23 is assembled onto the load member 71. The plates 71 are welded to the back wall 55 and to the tubular segments 59. Two plates 71 are provided per tubular segment 59, one of which is coupled to the top end of the tubular segment, with the other being secured to the bottom end. An arm 57 is pivotally coupled to each side portion 69 of the back wall 55. The arms 57 extend out in front of the back wall 55 to receive the load which is to be raised or lowered. In the preferred embodiment, the arms 57 are provided with a pair of wooden rails 75 for receiving a jet ski or other small boat. The rails 75, which are oriented perpendicularly to the arms 57, are coupled to the arms by way of mounting brackets 76. The arms 57 and rails 75 pivot between a deployed position as shown in FIG. 1, wherein the arms are generally perpendicular to the rail portion 27, and a stowed position as shown in FIG. 8, wherein the arms are generally parallel to the rail portion.

The lift cradle 23 is assembled onto the load member 21 as follows: the lift cradle 23 is raised up over the upper end 31 of the rail portion 27 and then lowered so that the rail portion 27 is received by the inside diameter of the bearings 63. Once both bearings 63 receive the rail portion 27, assembly of the cradle 23 onto the load member 21 is completed.

The lifting means 25 raises and lowers the lift cradle 23 and also rotates about the load member 21 with the lift cradle. The lifting mean 25 includes a conventional brake winch 77, a riser 79 and a cap 81. The cap 81 is a hollow sleeve with one end 83 closed. The inside diameter of the cap 81 is greater than the outside diameter of the rail portion 27. Annular UHMWPE bearings 85 are located inside of the cap 81 and secured thereto with bolts. The inside diameter of the bearings 85 is slightly larger than the outside diameter of the rail portion 27. A top bearing 87 is provided inside of the cap 81 at the closed end 83. The top bearing 87 is a circular disk of UHMWPE plastic. Alternatively, a single cup-shaped bearing can be used in lieu of the plural bearings 85, 87. The cup-shaped bearing has a closed end, which abuts the top end 31 of the load member. The riser 79 is coupled to the outside of the cap 81 and extends vertically upward. The winch 77 is secured to the upper end of the riser 79.

The lifting means 25 is assembled onto the upper end 31 of the rail portion 27 such that the top bearing 87 abuts the plugged upper end 31 of the rail portion and the annular bearings 85 surround the rail portion. The cable 89 from the winch 77 extends from the winch spool 91 to the upper plate 71A (see FIG. 1) on the lift cradle 23, where it is secured. The winch 77 is provided with a handle 93 or an electric motor to raise and lower the lift cradle.

The operation of the lift apparatus 11 will now be described. With the lift cradle 23 oriented relative to the dock 13 as shown in FIG. 1, wherein the arms 57 point away from the dock, the cradle can be raised and lowered along the length of the rail portion 27. To pick up a load, such as a jet ski, the lift cradle 23 is lowered into the water 15 with the winch 77. As the cradle 23 is lowered, the bearings 63 slide along the rail portion 27. When the cradle 23 is lowered below the dock walkway 19, the web 35 of the mounting portion 29 is received by the gaps 61, 65 in the tubular segments 59 and the bearing 63 on the lift cradle. Thus, the C-shaped tubular segments 59 and bearings 63, with their respective gaps 61, 65, enable the cradle 23 to slide up and down the entire length of the rail portion 27, without interference from the mounting means 37, 39.

With the cradle 23 in the water 15, the jet ski (not shown) is loaded onto the rails 75. Then, the cradle and jet ski are raised with the winch 77. When the cradle 23 is loaded, there is a tendency for the cradle to tilt relative to the load member 21. This tendency is prevented by the bearings 63 which maintain the horizontal orientation of the arms 57. The bearings 63 resist the tilt and compressive forces of the cradle 23, while permitting rotation of the cradle at the upper end of the rail portion 27. In addition, the C-shaped bearings 63 maintain the cradle in an orientation wherein the arms 57 point out away from the dock 13, when the bearings are located along the mounting portion 29. The web 35 in the gaps 61, 65 prevents rotation of the bearings 63 around the rail portion 27, while permitting up and down sliding movements. The winch cap 81 also has a tendency to tilt relative to the load member 21, due to the load. The cap bearings 85 prevent such tilting of the cap 81.

Figure 2:
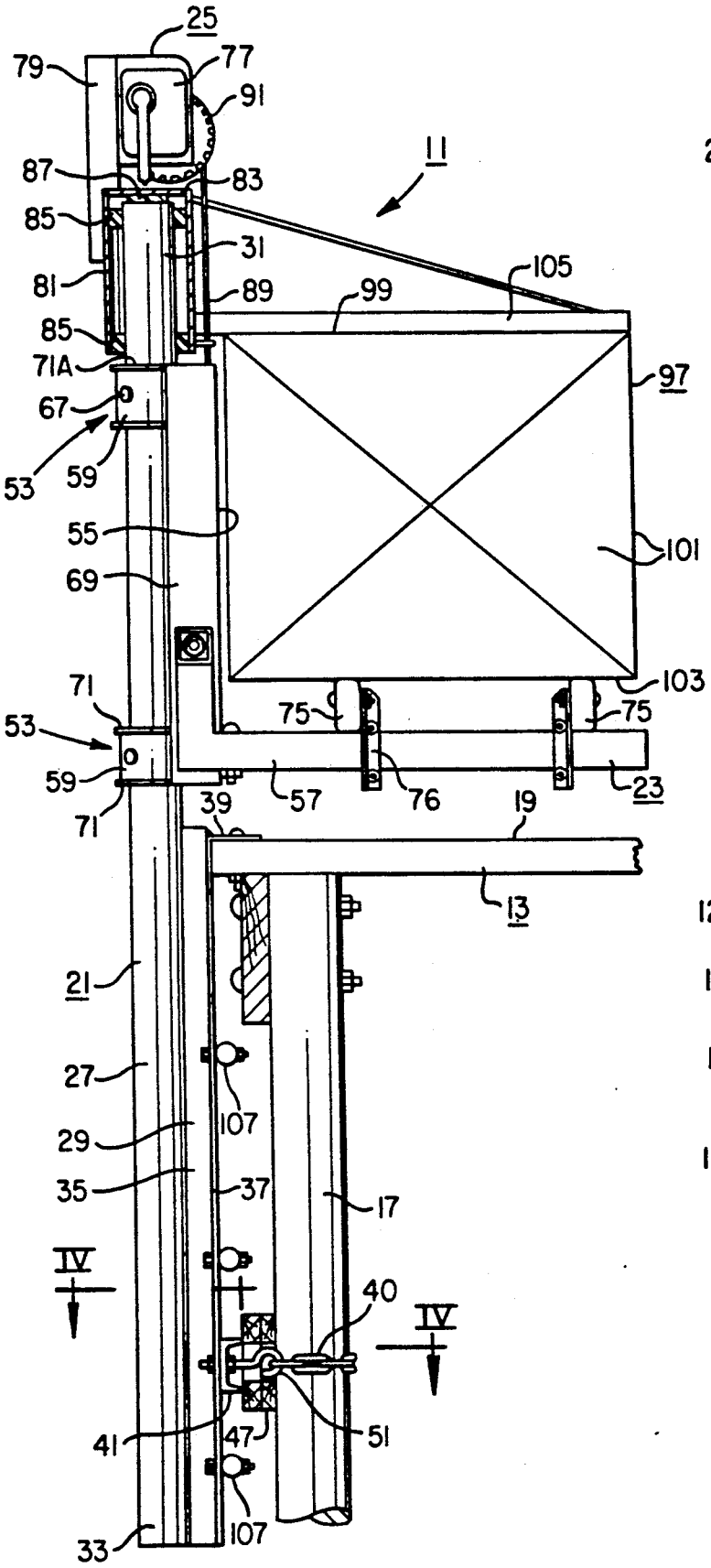
FIG. 2 is a side view of the lift apparatus of FIG. 1, shown with the cradle positioned over the dock and shown with an optional boat housing positioned over the cradle.

When the cradle 23 has been raised to the upper end portion of the load member 21, so that the bearings 63 are located above the mounting portion 29 and the gaps 61, 65 are free of the web 35, the cradle 23 is rotated 180 degrees relative to the load member in order to swing the cradle and the jet ski from a position over the water 15 (shown in FIG. 1) to a position over the dock 13 (shown in FIG. 2). Once the bearings 63 have cleared the mounting portion 29, the bearings are free to rotate on the rail portion 27 because the web 35 no longer constrains rotation. As the lift cradle 23 is rotated, the winch cap 81 is also rotated on the load member 21 to follow the cradle. Once the cradle 23 is over the dock 13, the jet ski can either be serviced while on the cradle or removed from the cradle and placed on a wheeled dolly. To lower the jet ski from the dock into the water, the process is reversed.

When the lift apparatus 11 is not in use, the cradle 23 may be rotated out over the water to clear the dock. Alternatively, the cradle arms 57 can be pivoted up to the stowed position, as shown in FIG. 8. The outboard rail 75 is provided with a hook 95 (see FIG. 1) to couple to the cable 89 when the arms 57 are in the stowed position. The hook 95 secures the arms 57 in the stowed position.

One aspect of the lift apparatus of the present invention is that lifting is simplified because both vertical and horizontal movement of the load are provided. The vertical movement allows the cradle 23 to slide up and down the rail portion 27 between the upper and lower ends 31, 33 of the rail portion. As will be explained hereinbelow, the rail portion 27, and even the mounting portion, can be extended both upwardly and downwardly, as the specific installation requires. The horizontal movement allows the cradle 23 to pivot or swing about the rail portion 27, so that the load can be moved between a position over the water and a position over the dock. Thus, a load can be lifted from the water and placed directly onto the dock.

This water-to-doc capability is due to the arrangement of the load member 21 and the cradle bearings 63. The load member 21 provides a track or rail 27 for guiding the cradle and the bearing in the vertical direction. The mounting plate 37 is stood off from the rail portion 27 by the web 35 so as not to interfere with the up and down movement of the bearings 63. The gaps 65 in the bearings 63 allow the bearings to slide along the web 35. When the bearings are free of the web 35, the cradle can rotate about the rail portion 27. By positioning the mounting portion 29 below the dock walkway 19, the cradle is free to rotate when located above the dock walkway.

Another aspect of the present invention is the flexibility in mounting arrangements to a structure provided by the mounting portion 29. The T-shaped mounting portion 29 that extends parallel to the rail portion 27 allows the load member 21 to be mounted to an adjacent load bearing structure such as a dock, a pier, a large boat transom, a wall, etc. The mounting portion 29 can be fastened to supporting or stabilizing structure by being bolted or clamped directly to such structure or indirectly by way of angle irons 39, chains 40, flat plates 130, etc. Alternatively, mounting means hardware in lieu of the mounting plate 37 can be coupled directly to the outer end of the web 35, such as is shown in FIG. 2 where the angle iron 39 is welded to the web 35. Thus, the mounting plate 37 can be used to couple the load member, or a mounting means substitution can be made for the mounting plate, which mounting means substitution is coupled to and stood off from the rail portion 27 by way of the web 35.

The mounting plate 37 simplifies installation of the load member onto the load bearing structure. No heavy equipment is required for installation, such as would be the case if load-bearing pilings were utilized. In the preferred embodiment, the mounting plate 37 is continuous to provide flexibility in choosing locations along the mounting plate, wherein the load member can be attached to a wide variety of structures. The mounting plate 37 allows plural load points for mounting the load member to a structure to distribute the load. However, the mounting plate need not be continuous, instead it can be fashioned in discrete segmented lengths along the rail portion. Also, the mounting plate need not extend up to the dock walkway if the mounting plate is coupled to the dock structure at a lower location.

The cradle 23 may be provided with a protective housing or covering 97 to shelter the jet ski, when the cradle is located at the upper end portion of the load member 21. The housing 97 is generally rectangular and has a top wall 99 and four side walls 101. The bottom 103 is open to receive the jet ski. The housing 97 is suspended by a suspension arm arrangement 105 which is coupled to the winch cap 81. Thus, as the jet ski is being raised from the water 15, it enters the housing 97 from the bottom 103. As the cradle 23 is rotated to over the dock, the housing 97 also rotates. One of the side walls 101 of the housing may be opened, to allow access to the interior.

In addition, the lift apparatus 11 may be provided with ladder rungs 107 on the load member 21, as shown in FIGS. 1 and 2. The rungs 107 allow an operator to climb up and down the load member. The rungs are bolted to the back of the mounting plate 37, so as to not to interfere with the up and down movement of the cradle 23 on the load member.

Figure 5:
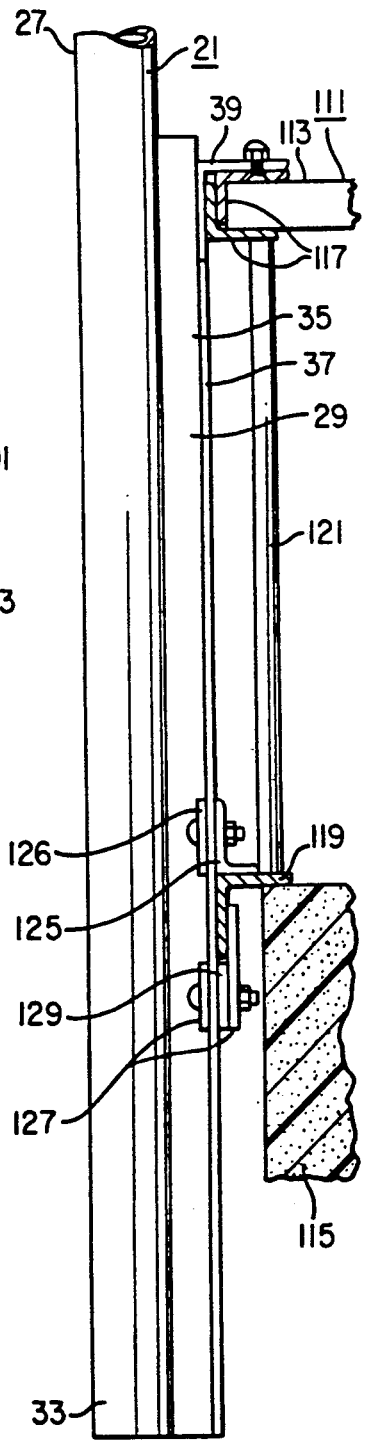
FIG. 5 is a side view of the lower portion of the load member shown mounted onto a floating dock.
Figure 6:
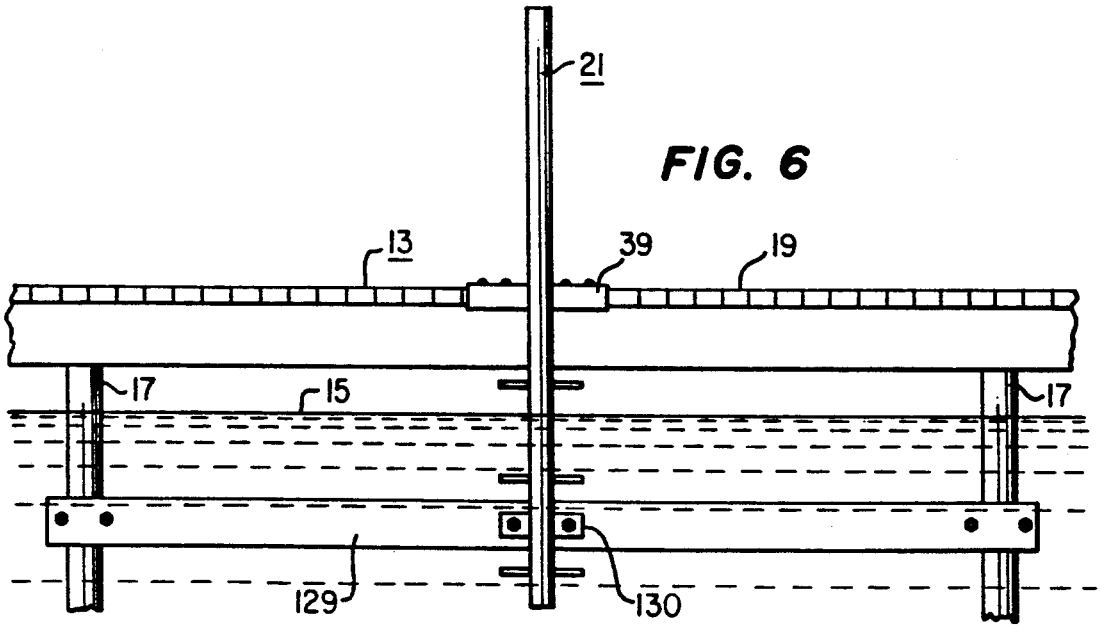
FIG. 6 is a front view of the load member shown mounted between two piers on a dock.

As described hereinabove, the lift apparatus 11 can be easily secured to a wide variety of structures. In FIGS. 5 and 6, the load member 21 is shown coupled to different types of docks. In FIG. 5, there is shown the load member 21 secured to a floating dock 111. The floating dock has an upper dock walkway 113 and a lower flotation mass 115. The dock 111 has horizontal angle irons 117 along the side of the walkway 113 and a horizontal angle iron 119 along the side of the flotation mass 115. The upper and lower angle irons 117, 119 are braced together by diagonal rods 121. The load member 21 is secured to the upper and lower angle irons 117, 119 at the mounting plate 37. The upper end of the mounting portion 29 is provided with an angle iron 39, which is secured to the edge of the dock walkway 113 and, more specifically, to the upper dock angle irons 117. Another angle iron 125 is clamped to the mounting plate 37 with a clamping plate 126 and is positioned to bear on the lower dock angle iron 119. The mounting portion 29 is also clamped to the lower dock angle iron 119 with clamping plates 127. A spacer plate 129, having the same thickness as the lower dock angle iron 119, is interposed between the mounting plate 37 and the rearward clamping plate 127. Thus, the lower dock angle iron 119 is interposed between the mounting plate 37 and the rearward clamping plate. The weight born by the load member 27 is distributed between the upper and lower dock members 117, 119.

Still another arrangement for securing the load member 21 to a boat dock is shown in FIG. 6. The load member 21 is again secured to the edge of the boat walkway 19, but at a location that is between two piers 17. In order to brace the lower end of the load member to stabilize the vertical orientation, a horizontal beam 129 is extended between the two adjacent piers 17. The lower end of the load member is then secured, by way of a flat plate 130 that is clamped or bolted to the mounting plate 37, to the beam 129. Besides stabilizing the vertical orientation, the beam 129 may be used to bear some of the weight, thus distributing the weight between the walkway 19 and the beam 129.

With the load member installed onto the floating dock of FIG. 5, or alternatively onto the beam of FIG.

6, the mounting portion 29 of the load member 21 does not extend upwardly beyond the dock walkway, to permit rotation of the cradle at the upper end of the load member. Furthermore, the cradle and lifting means are assembled and operated as described above.

Figure 7:
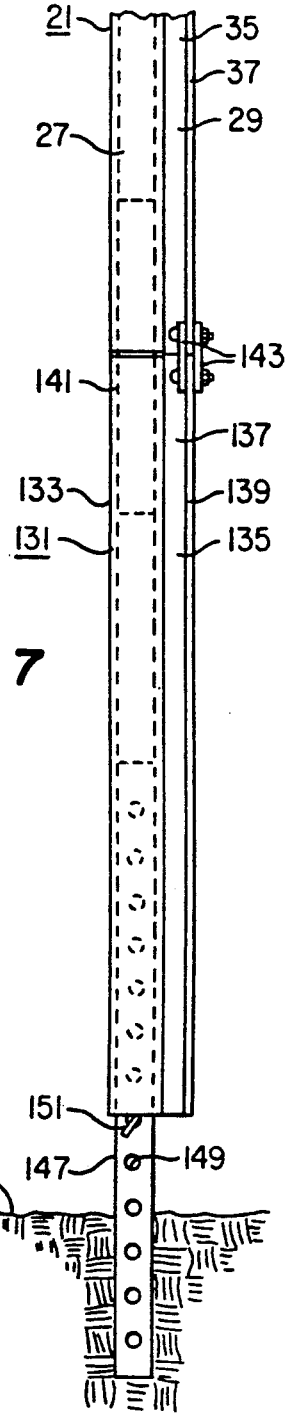
FIG. 7 is a side view of the load member shown with an extension load member which is anchored to the bottom of the water body.

The length of the load member 21 may be extended, as shown in FIG. 7, whenever required by the particular use to which the lift apparatus is put. The load member 21 is extended downwardly by providing an extension load member 131. The extension load member 131 has a rail portion 133 and a mounting portion 135. The mounting portion 135 has a web 137 and a mounting plate 139, which forms a T-shaped member. The mounting portion 135 is coupled to and extends along the length of the rail portion 133. The load member 21 and the extension load member 131 are aligned end to end. The two rail portions 27, 133 are coupled together by an insert 141 that is inserted into the inside diameters of the rail portions. The insert 141 has an interference fit with the rail portions. Alternatively, the insert can be threaded into the inside diameters of the rail portions. The two mounting portions 29, 135 are coupled together by pairs of clamping plates 1 43. Each pair of clamping plates 143 extends onto both mounting plates 37, 139. Thus, the extension load member is secured to the load member. The load member, and in particular the rail portion, can be extended upwardly by providing an extension rail portion and an insert to couple the two rail portions together.

Occasionally, it may be desired to anchor the lower end of the load member to the bottom 145 of the water body. Anchoring prevents movement of the lower end of the load member thus providing vertical stability of the load member. Furthermore, anchoring permits the bottom 145 to bear the load, wherein vertical stability is provided by bracing to some structure such as a dock. The load member is anchored to the bottom 145 by way of an extendable inner tube 147. The inner tube 147 has an outside diameter that is smaller than the inside diameter of the rail portion 133, so as to allow the insertion of the inner tube into the rail portion. The upper end of the inner tube 147 is retained inside of the load member and the lower end of the inner tube is secured in the bottom 145. The inner tube is provided along its length with plural holes 149 for receiving a pin 151.

Figure 4:
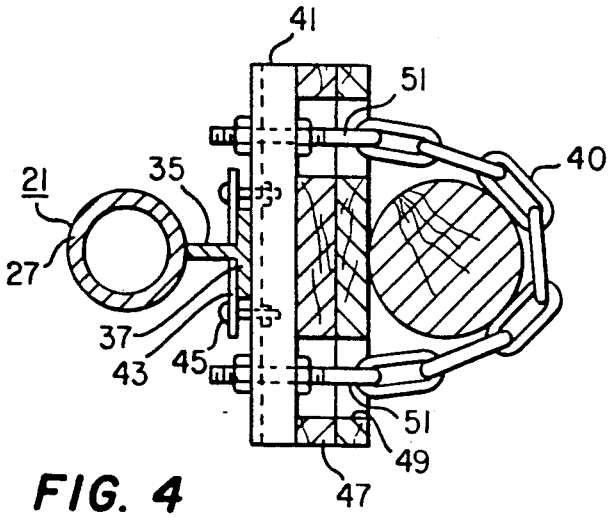
FIG. 4 is a cross-sectional view taken through lines IV—IV of FIG. 2.

The inner tube 147 is driven into the bottom 145 in the following manner. With the inner tube 147 bearing onto the bottom 145, the pin 151 is inserted into a hole 149 and the load member 21, 131 is placed over the upper end of the inner tube until the rail portion 133 bears on the pin 151. Then, the load member 21, 131 is picked up and dropped onto the pin 151, driving the inner tube 147 into the bottom 145 in a manner similar to driving a piling. As the inner tube is driven down, the pin 151 is advanced to upper holes to stay clear of the bottom 145. During the driving operation, the vertical orientation of the load member 21, 131 is stabilized by bracing to a pier 17, as shown in FIG. 4. The clamping plates 43 are loosened however, so as to allow the up and down movement of the load member.

The lift apparatus 11 is easily transported to and from the dock. Referring to FIG. 8, an axle 153 is clamped to the mounting plate 37 of the load member 21. Wheels 155 are rotatably coupled to the axle 153. With the wheels 155 located at the lower end of the load member, the load member 21 may be tilted back to serve as a dolly. The lifting means 25 and cradle 23 are assembled thereon, with the arms 57 of the cradle in the stowed position. Thus, the entire lifting apparatus 11 can be wheeled to and from the dock site.

Figure 9:
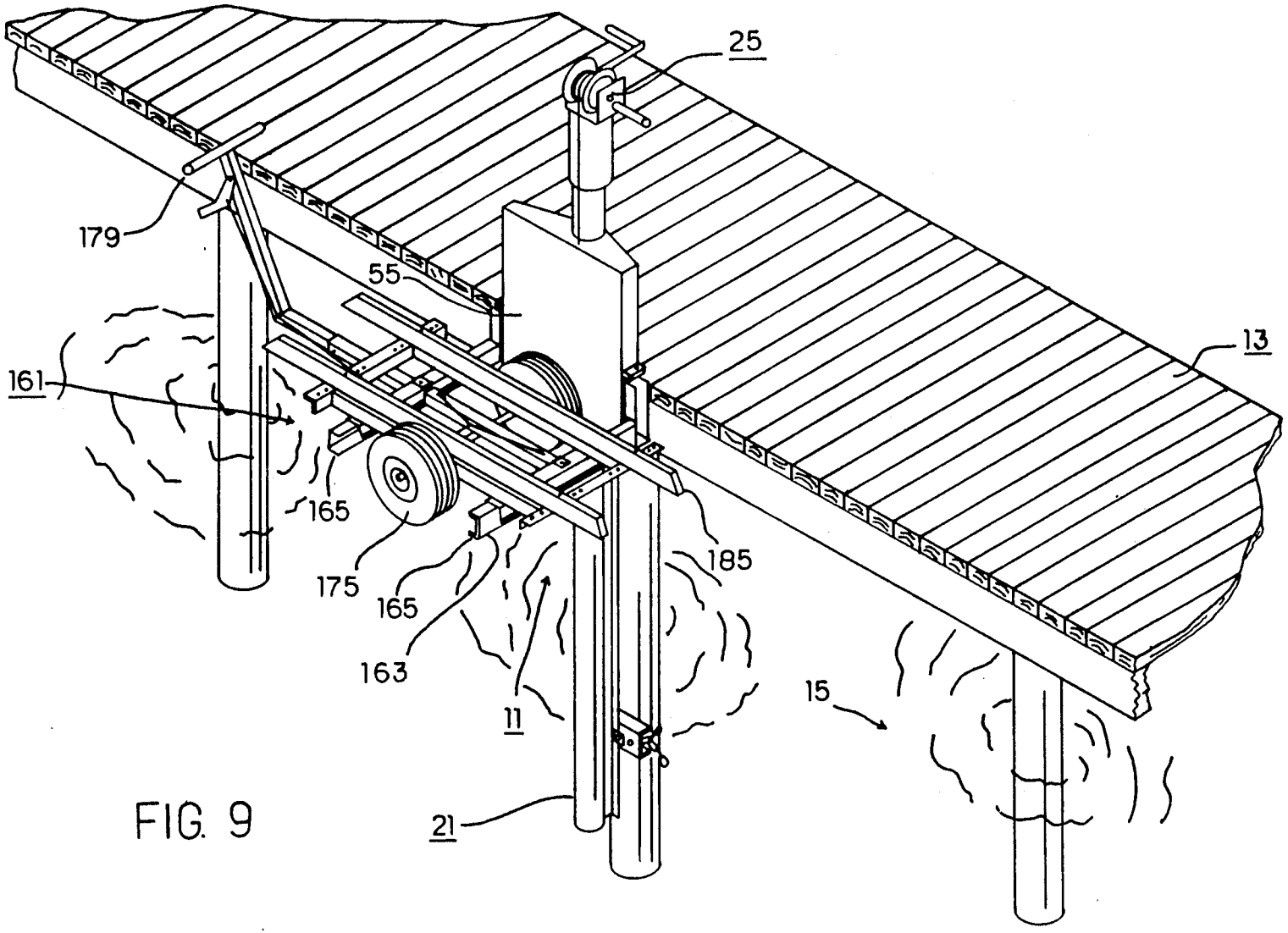
FIG. 9 is an isometric view of the lift system of the present invention, in accordance with a preferred embodiment, shown mounted onto a dock with the cart positioned over the water.
Figure 10:
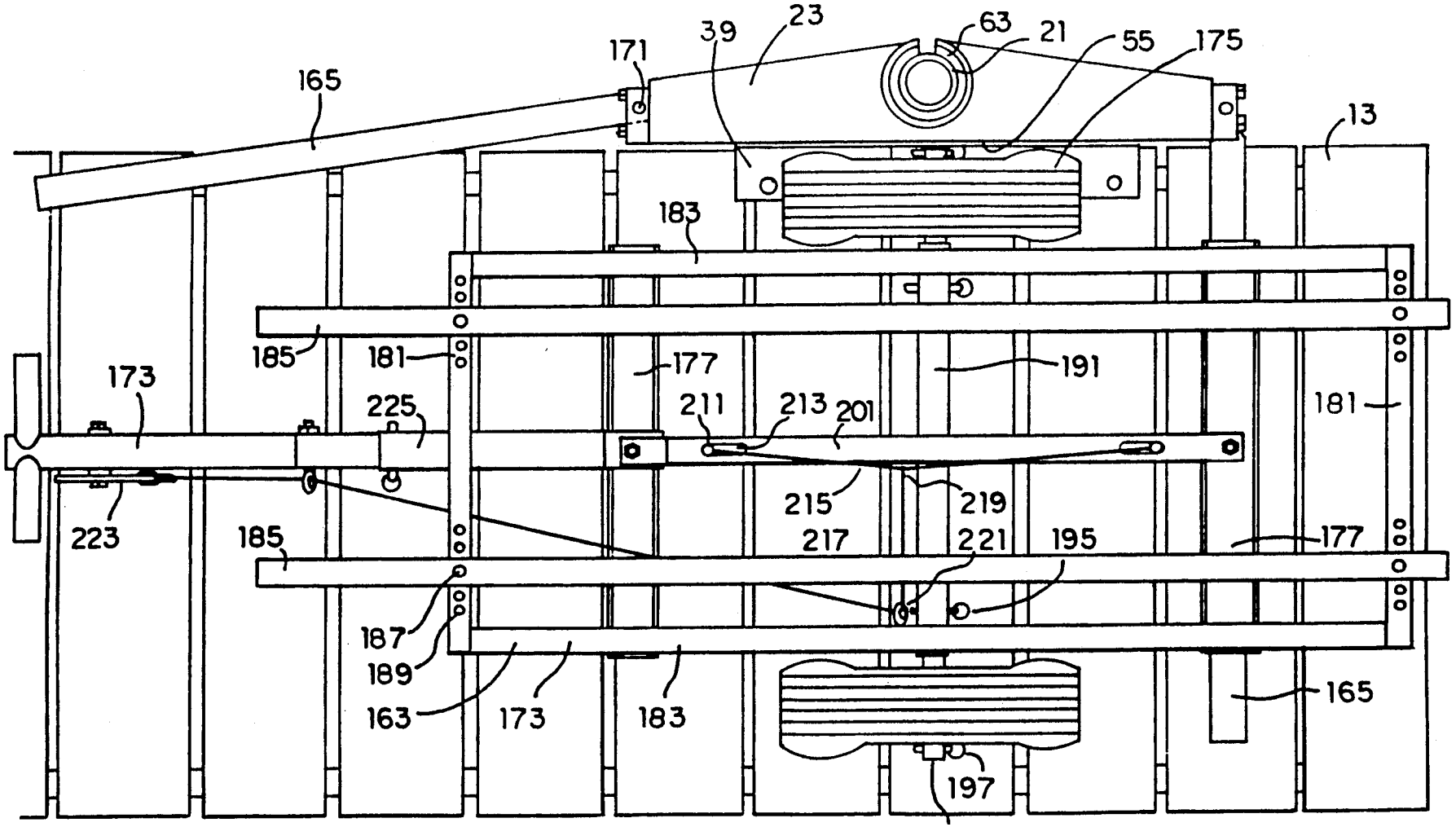
FIG. 10 is a top plan view of the cart, showing the cart structure and the lock release mechanism.
Figure 11:
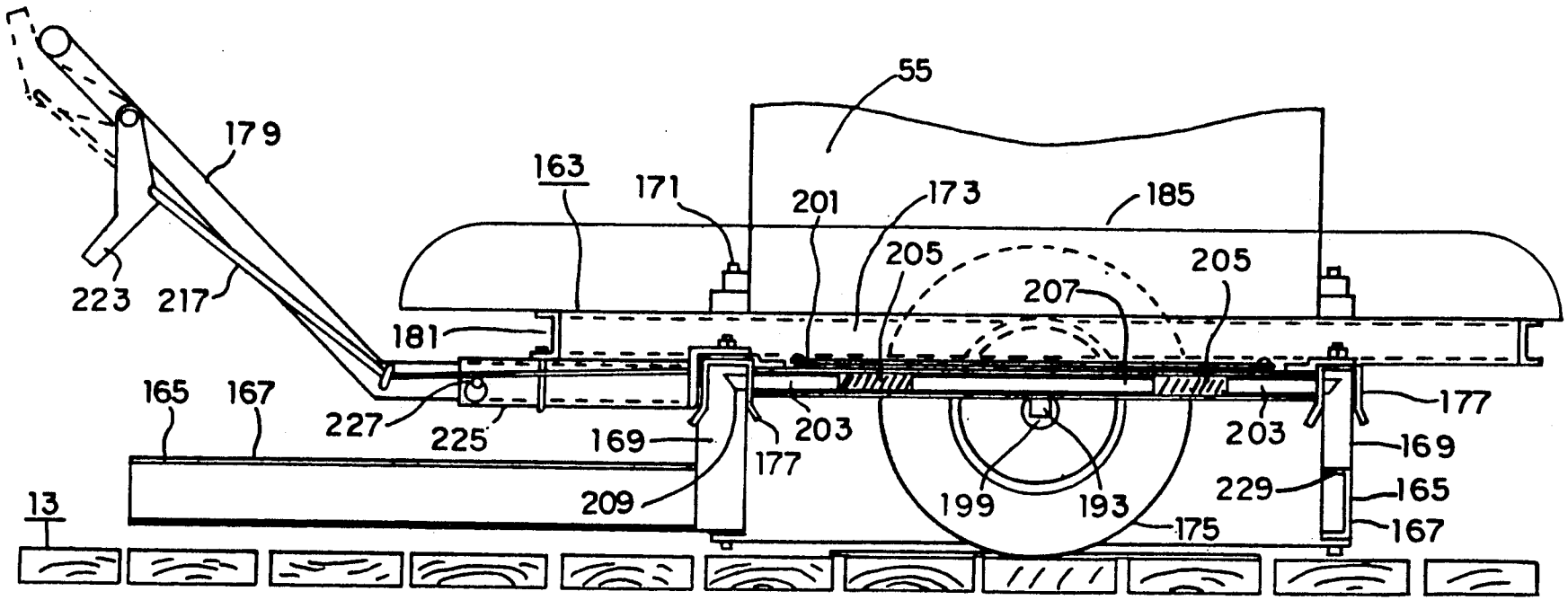
FIG. 11 is a side elevational view of the cart on a dock, showing the lifting arms of the lift apparatus.

The lift apparatus described above can be incorporated into a lift system 161, as shown in FIGS. 9-11. With the lift system 161 of the present invention, a jet ski or other load can be rolled out from storage, loaded onto the lift apparatus and lowered down to the water, all without manually lifting the jet ski. In addition to the lift apparatus 11, the lift system 161 utilizes a wheeled cart 163 for bearing the jet ski or other load. The cart 163 allows the jet ski to be easily transported over the ground and the dock 13 to and from the lift apparatus 11. To utilize the lift apparatus 11, the cart 163 is coupled to the lift apparatus so that the cart and the load are both lifted by the lift apparatus.

The lift apparatus 11 is as described above, with reference to FIGS. 1-8, with the exception of the arms 165. The arms 165 have been modified to allow the cart 163 to be positioned adjacent to the lift cradle 23 and to provide for the secure coupling of the cart to the lift cradle. Each arm 165 is shaped like a sideways "L", having a long portion 167 that extends out from the back wall 55 of the lift cradle 23 and a short portion 169 that is coupled to the lift cradle 23. The long portion 167 is made of a "U" shaped channel member. The channel members 167 are oriented with respect to each other so that the open ends face each other, as shown in FIG. 9. The short portions 169 are coupled to the lift cradle 23 by respective hinge arrangements 171 such that the arms 165 can swing about a vertical axis.

The cart 163 includes a frame 173, wheels 175, locking channels 177 and a handle 179. The frame 173 is generally rectangular and is sized so as to support the desired load. The frame 173 has end and side members 181, 183 coupled together as shown in FIG. 10. Two parallel wooden rails 185 are provided for supporting a jet ski or other small boat. (In FIG. 10, the rails are shown in dashed lines.) The rails 185 are coupled to the end members 181 by bolts 187. The end members 181 may be provided with plural bolt holes 189 to allow the spacing between the rails 185 to be adjusted for the particular jet ski. A wheel axle tube 191 extends between and is coupled to the side members 183. Each end of the axle tube 191 receives a portion of a wheel axle 193. Each wheel axle 193 is retained inside of the axle tube 191 by a conventional snap ball pin 195. The wheels 175 are mounted onto the free ends of the axle 193 and are retained by snap ball pins 197. Solid plastic bearings 199 are used to rotatively couple the wheels 175 to the axles 193. The solid bearings 199 provide a longer life than roller bearings in a wet environment. Each wheel 175 is provided with its own axle 193 so that the distance between the wheels can be adjusted for the particular load that is carried. The inner portions of the axles 193 are provided with plural openings for receiving the pins 197. To change the distance between the wheels 175, the axles 193 are telescoped in or out of the axle tube 191 and then repinned in place.

Two locking channels 177 are coupled to the frame 173. The locking channels 177 extend across the side members 183 and are separated by the same distance that the arms 165 are separated from each other. The locking channels are inverted "U" shaped channel members coupled to the side members of the frame. Thus, the open ends of the locking channels 177 face downwardly, towards the arms 165. The locking channels 177 are sized so as to matingly receive the long portions 167 of the arms. The ends of the locking channels are flared outwardly to ease the reception of the arms into the locking channels.

A locking mechanism is provided to lock the cart 163 to the lift cradle 23. A longitudinal tube 201 extends between the locking channels 177. Reffering to FIG. 11, at each end of the longitudinal tube 201 there is a slam latch pin 203. Each latch pin 203 projects out of the longitudinal tube 201, through an opening in the respective locking channel 177 and into the locking channel as shown in FIG. 11. The latch pins 203 are biased in their projecting positions by springs 205 and a filler pin 207, both of which are located in the longitudinal tube 201. The filler pin 207 is located between the two springs 205, wherein the springs push against the filler pin. Each slam pin 203 has a beveled surface 209 for slam actuation. Each slam pin 203 also has a small projection 211 on its upper surface, as shown in FIG. 10. The small projections 211 are received by slots 213 in the longitudinal tube 201. The small projections 211 are coupled together by a first cable 215 that is located outside of the longitudinal tube 201. A second cable 217 has a loop 219 in one end that receives the first cable 215. The second cable 217 extends generally transversely from the first cable to an eye bolt 221 mounted in a side member 183 and then on to a pivoting lever 223 on the handle 179. The first and second cables 215,217 provide a lock release mechanism for releasing the slam pins 203 for unlocking the cart. As the second cable 217 is pulled tight by actuating the lever 223, the first cable 215 is pulled, thereby pulling the slam pins 203 inwardly and releasing the cart 163 from the arms 165.

The handle 179 has a mounting tube 225 that is coupled to one end of the frame 173. One end of the handle 179 is retained inside of the mounting tube 225 by a snap ball pin 227. The handle length can be adjusted by telescoping the handle 179 in and out of the mounting tube 225.

The operation of the lift system 161 will now be described. With the jet ski loaded onto the cart 163, the cart can be wheeled to and from the lift apparatus 11. Before moving the cart 163 next to the lift cradle 23, one of the arms 165 is swung open as shown in FIG. 10. The other arm 165 can be locked in place to prevent it from swinging and to make the alignment of the cart with the arms easier. A bolt extending through the short portion 169 of the arm and lift cradle 23 is suitable for locking the arm in place. The lift system is provided with both arms being capable of swinging movement so that the owner can select which arm to lock in place in accordance with his particular installation.

With one arm 165 swung open, the cart 163 is moved into position such that one wheel 175 is adjacent to the lift cradle 23 and one of the locking channels 177 is positioned over the locked arm (see FIG. 10). Then, the open arm is swung closed, wherein it is located below the other locking channel.

Next, the winch 25 is operated to raise the lifting cradle 23 up off of the dock 13. As the arms 165 are received by the locking channels 177, the slam pins 203 are forced inwardly towards each other by the upper portion 299 of each arm contacting the beveled surface 209. Once the upper portion of each arm clears the respective slam pin, the springs 205 force the slam pins back outwardly. The arms 165 are now retained within the locking channel 177 by virtue of their upper portions 229 being located below the slam pins in the upper portions of the locking channels.

The locking of the cart 163 onto the arms 165 by the slam pins 203 occurs automatically as the lift cradle 23 is being raised. The lift cradle 23 is raised high enough so that the wheels 175 of the cart 163 clear the dock 13. When so raised, the cart 163 is securely supported and retained by the lift cradle 23. The long portions 167 of the arms 165 are matingly received by the locking channels 177. The cart cannot be tipped or moved in any direction independently of the lift cradle.

The lift cradle is rotated about the load member 21 in order to position the cart and the load out over the water 15, as shown in FIG. 9. (In the figures, the load is not shown in order to better illustrate the structure of the lift system.) The lift cradle 23 is then lowered by the winch 25 until the load, such as a jet ski, lies in the water.

To lift the load back onto the dock, the procedure is reversed. To decouple the cart 163 from the lift cradle 23, the lever 223 on the handle 179 is pulled up, thereby tightening the second cable 217, the first cable 215 and drawing the slam pins 203 inwardly to unlock the cart from the arms. The lift cradle 23 is then dropped to the dock 13 so that the arms 165 exit the locking channels 177. The cart 163 is pulled out away from the lift cradle, with the wheels 175 pushing the swinging arm open. The cart 163 can then be moved away from the lift apparatus into a storage location. In addition, by moving the cart away from the lift apparatus 11, the lift apparatus is free to operate with another cart and load.

The cart provides for theft deterrence by allowing the wheels 175 to be removed. The snap ball pins 197 are removed and the wheels are taken off of the cart. The cart then rests on the ground without wheels or any easy way of movement.

The cart 163 itself can be used to load a jet ski onto the cart. A winch can be provided on the handle. To load a jet ski, the cart is tipped to locate the ends of the rails beneath the jet ski. The winch then pulls the jet ski fully onto the cart and the rails. To unload the jet ski from the cart, the procedure is reversed. When so used, no manual lifting of the jet ski is required to transfer the jet ski between the cart and the ground.

Figure 12:
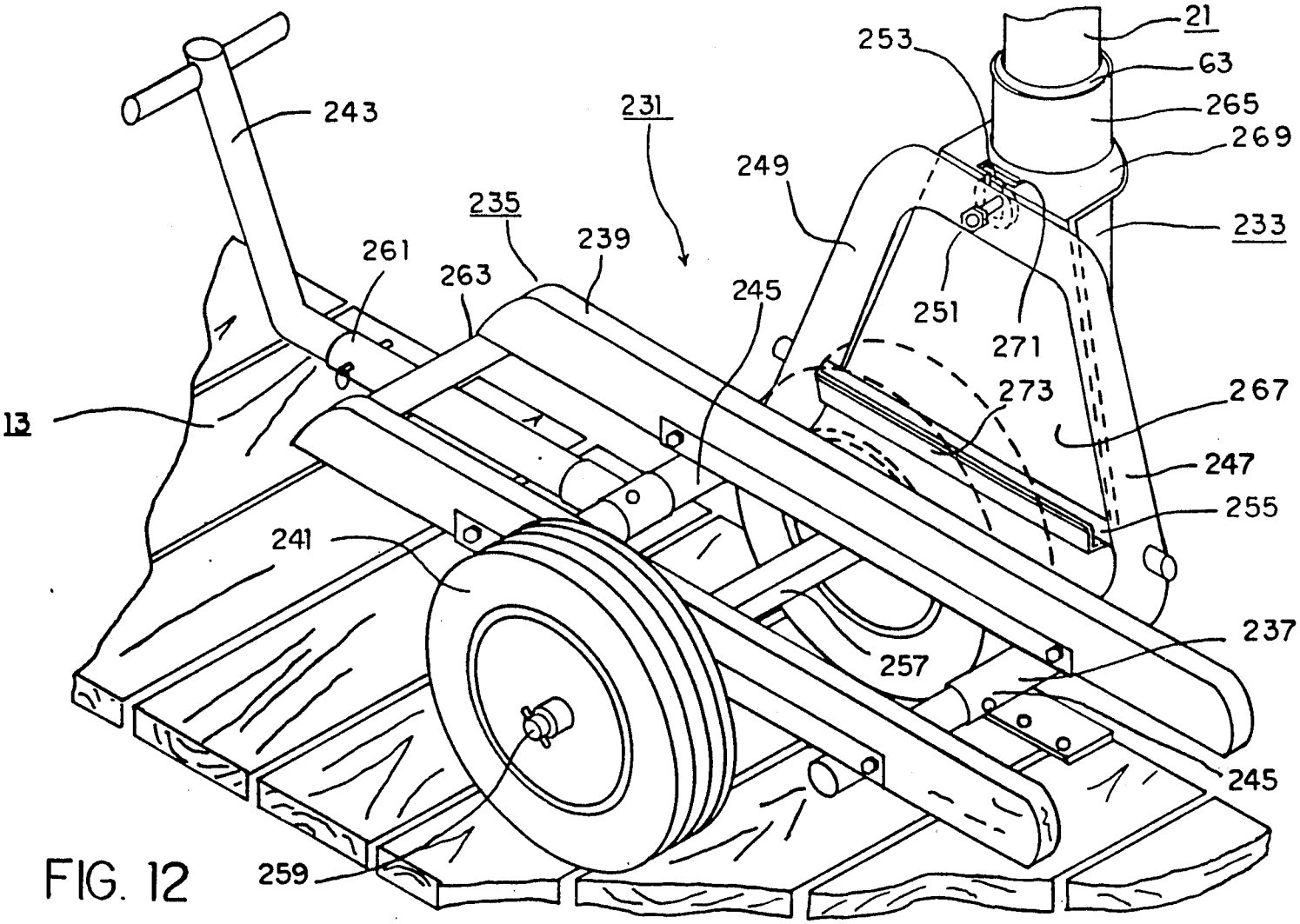
FIG. 12 is an isometric view of the lift system of the present invention, in accordance with another embodiment.

In FIG. 12, there is shown another embodiment of the lift system 231 of the present invention. In this embodiment, the lift cradle 233 has been modified to eliminate the arms. Instead the cart 235 is coupled directly to the lift cradle.

The cart 235 has a frame 237, rails 239, wheels 241 and a handle 243. The frame 237 has two transverse members 245 that are spaced apart. The rails 239 are coupled to the transverse members 245 to form a rigid structure. The frame 237 also has a coupling portion 247 located to one side. The coupling portion 247 is shaped like an inverted "U", with its ends coupled to an end of each of the transverse member 245. The coupling portion 247 has an upper bar 249 with a large headed bolt 251 extending therethrough. The head 253 of the bolt is located outwardly from the cart 235. A crossbar 255 is provided near the bottom section of the coupling portion 247.

An axle tube 257 is coupled to the rails 239 to house and retain the wheel axles 259, as described above. The handle 243 is received by a mounting tube 261. The mounting tube 261 is coupled to a transverse member 245 and to a crossbeam 263 that extends between the rails 239 at one end of the cart. The wheels 241 and handle 243 move in and out to adjust their positions. Likewise, the transverse members 245 have a telescoping arrangement so that one rail can be moved with respect to the other rail to vary the spacing between the rails 239.

The lift cradle 233 has guide means 265 and a back wall 267. The guide means is a tube 265 with upper and lower bearings 63. The tube 265 and bearings 63 cooperate with the load member 21 as described above with respect to FIGS. 1–8. The back wall 267 is coupled to the guide means tube 265 by collars 269. The upper end of the back wall 267 has a slot 271 for receiving the bolt 251 on the coupling portion. The lower end of the back wall 267 has a channel member 273 for receiving the crossbar 255 on the coupling portion 247. The channel member 273 has an edge that is flared outwardly to ease the reception of the crossbar 255.

To operate the lift system 231 of FIG. 12, the cart 235 is wheeled into place adjacent to the lift cradle 233. As the lift cradle 233 is raised off of the dock 13, the channel member 273 receives the crossbar 255 and the slot 271 receives the bolt 251 such that the back wall 267 is interposed between the coupling portion 247 and the bolt head 243. The lift cradle 233 is raised until the cart 235 clears the dock 13. The lift apparatus 11 may then be operated as described above.

The cart 235 is securely supported by the lift cradle 233 such that the cart is prevented from moving or tipping independently of the lift cradle. The coupling arrangement between the cart and the lift cradle uses a three point system for secured coupling. The three point coupling system utilizes a minimum of three coupling points between the cart and the lift cradle. The three coupling points form the apexes of an imaginary triangle to provide maximum stability. In FIG. 12, the three coupling points are the bolt 251 and the ends of the crossbar 255. In addition, the entire length of the crossbar 255 is coupled to the lift cradle.

To decouple the cart 235 from the lift cradle 233, the lift cradle is dropped to the dock, whereby the crossbar 255 and the bolt 251 are no longer retained by the back wall 267. The cart can then be moved away from the lift apparatus.

The foregoing disclosure and the showings made in the drawings are merely illustrative of the principles of this invention and are not to be interpreted in a limiting sense.

I claim:

1. A lift system, comprising:

a) an elongated load member comprising a rail portion and mounting means, said load member also comprising coupling means for coupling said mounting means to said rail portion, said rail portion having a section that is free of said mounting means and said coupling means;

b) a lift cradle mounted onto said rail portion such that said lift cradle can slide along said rail portion, said lift cradle having bearing means for sliding along said rail portion, said bearing means having a gap for receiving said coupling means such that said bearing means can slide along said rail portion section with said mounting means and said coupling means;

c) said lift cradle being capable of rotating about said rail portion when said bearing means is located along said rail portion section that is free of said mounting means and said coupling means;

d) platform means for supporting a load, said platform means allowing said load to be transported away from said lift cradle;

e) securing means for securing and coupling said platform means to said lift cradle such that when said lift cradle lifts said load said platform means is also lifted, said securing means being releasable.

2. A lift system, comprising:

a) an elongated load member having track means, said load member having mounting means for coupling said load member to a bearing structure, said mounting means being coupled to said track means and being stood off from said track means by standoff means;

b) a lifting body that traverses said track means, said lifting body comprising guide means for guiding said lifting body along said track means, said guide means having bearing means for slidably engaging said track means so as to slide thereon, said bearing means having gap means for receiving said standoff means so that said bearing means can slide on said track means and along said standoff means;

c) load coupling means for coupling a load to said lifting body, said load coupling means comprising support members that are adapted to engage said load, said load coupling means being removably coupled to said lifting body by way of a three point coupling means, said three point coupling means comprising three coupling points that are arranged so as to form the apexes of an imaginary triangle.

3. The lift system of claim 2 wherein said three point coupling means automatically couples said load coupling means to said lifting body when said load coupling means is aligned with said lifting body and said lifting body is raised to engage said load coupling means.

4. The lift system of claim 3 wherein said load coupling means comprises wheel means for moving said load coupling means from place to place, wherein said load coupling means can transport said load to and from said lifting body.

5. The lift system of claim 2 wherein said load coupling means comprises wheel means for moving said load coupling means from place to place, wherein said load coupling means can transport said load to and from said lifting body.

6. The lift system of claim 2 further comprising winch means for moving said lifting body along said track means, said winch means being coupled to an upper end of said track means.

7. The lift system of claim 2 wherein said bearing means is made of a solid material having a low friction surface that contacts said track means.

8. The lift system of claim 2 wherein said mounting means and said standoff means form a T-shaped member having arm portions and a stem portion, said stem portion including said standoff means and said arm portions including said mounting means.

9. The lift system of claim 2 wherein:

a) said three point coupling means automatically couples said load coupling means to said lifting body when said load coupling means is aligned with said lifting body and said lifting body is raised to engage said load coupling means;

b) said load coupling means comprises wheel means for moving said load coupling means from place to place, wherein said load coupling means can transport said load to and from said lifting body;

c) said bearing means is made of a solid material having a low friction surface that contacts said track means;

d) said mounting means and said standoff means form a T-shaped member having arm portions and a stem portion, said stem portion including said standoff means and said arm portions including said mounting means.

10. A lift system, comprising:

a) an elongated load member having track means, said load member having mounting means for coupling said load member to a bearing structure, said mounting means being coupled to said track means and being stood off from said track means by standoff means;

b) a lifting body that traverses said track means, said lifting body comprising collar means for guiding said lifting body along said track means, said collar means having bearing means for slidably engaging said track means, said bearing means having gap means for receiving said standoff means so that said bearing means can slide on said track means and along said standoff means;

c) said lifting body having upper and lower ends, said lifting body having a first coupling recess located near said lifting body upper end, said lifting body having a channel member located near said lifting body lower end, said channel member being horizontal;

d) load coupling means for coupling a load to said lifting body, said load coupling means comprising arm means for engaging said load and coupling means for removably coupling said load coupling means to said lifting body, said arm means being coupled to said coupling means, said coupling means having a projection that is received by said first coupling recess on said lifting body, said coupling means having a cross bar that is received by said channel member on said lifting body;

e) said first coupling recess and said channel member having open top ends, wherein said loading coupling means becomes coupled to said lifting body by raising said lifting body so that said projection and said cross bar become respectively received by said first coupling recess and said channel.

11. The lift system of claim 10 wherein said load coupling means comprises wheel means for moving said load coupling means from place to place, wherein said load coupling means can transport said load to and from said lifting body.

12. A lift system, comprising:

a) an elongated load member having track means extending between upper and lower ends of said load member and having mounting means located intermediate of said upper and lower ends, said mounting means being coupled to and stood off from said track means by standoff means, said mounting means being adapted to couple to structure located adjacent to said load member;

b) a lifting body that traverses said track means, said lifting body comprising guide means for guiding said lifting body along said track means, said guide means having bearing means for slidably engaging said track means so as to slide thereon, said bearing means having gap means for receiving said standoff means so that said bearing means can slide between said upper and lower ends of said load member;

c) said bearing means allowing said lifting body to turn about said track means when said bearing means gap is free of said standoff means;

d) load coupling means for coupling a load to said lifting body, said load coupling means comprising support members that are adapted to engage said load, said load coupling means being removably coupled to said lifting platform by way of a three point coupling means, said three point coupling means comprising three coupling points that are arranged so as to form the apexes of an imaginary triangle.

13. The lift system of claim 12 wherein said load coupling means comprises wheel means for moving said load coupling means from place to place, wherein said load coupling means can transport said load to and from said lifting body.

14. A lift system, comprising:

a) an elongated load member having track means, said load member having mounting means for coupling said load member to a bearing structure, said mounting means being coupled to said track means and being stood off from said track means by standoff means;

b) a lifting body that traverses said track means, said lifting body comprising guide means for guiding said lifting body along said track means, said guide means having bearing means for slidably engaging said track means so as to slide thereon, said bearing means having gap means for receiving said standoff means so that said bearing means can slide on said track means and along said standoff means.

15. The lift apparatus of claim 14 wherein said bearing means is made of a solid material having a low friction surface that contacts said track means.

16. The lift apparatus of claim 14 wherein said mounting means and said standoff means form a T-shaped member having arm portions and a stem portion, said stem portion including said standoff means and said arm portions including said mounting means.

17. The lift apparatus of claim 16 further comprising clamp means for clamping to said mounting means, said clamp means being coupled to said mounting means and being coupled to said structure.

18. The lift apparatus of claim 14 wherein:

a) said bearing means is made of a solid material having a low friction surface that contacts said track means;

b) said mounting means and said standoff means form a T-shaped member having arm portions and a stem portion, said stem portion including said standoff means and said arm portions including said mounting means.

19. The lift apparatus of claim 14 further comprising clamp means for clamping to said mounting means, said clamp means being coupled to said mounting means and being coupled to said structure.

* * * * *